United States Patent [19]

Storm, Jr.

[11] 4,355,432

[45] Oct. 26, 1982

[54] HAND TOOL FOR SCRAPING PAINT FROM PAINT CAN

[76] Inventor: James P. Storm, Jr., 329 Linfield Pl., Menlo Park, Calif. 94025

[21] Appl. No.: 159,251

[22] Filed: Jun. 13, 1980

[51] Int. Cl.[3] ..... A47G 21/00

[52] U.S. Cl. ..... 15/245; 15/236 R

[58] Field of Search ..... 15/236 R, 245

[56] References Cited

U.S. PATENT DOCUMENTS

| | | | |
|---|---|---|---|
| 755,521 | 3/1904 | Mortimer | 15/245 UX |
| 1,704,329 | 3/1929 | Klaus | 15/236 R |
| 2,264,374 | 12/1941 | Henschell | 15/236 R UX |
| 4,159,839 | 7/1979 | Sigler | 15/236 R X |

FOREIGN PATENT DOCUMENTS

| | | | |
|---|---|---|---|
| 232247 | 7/1910 | Fed. Rep. of Germany | 15/236 R |
| 78858 | 8/1955 | Netherlands | 15/236 R |
| 144804 | 4/1954 | Sweden | 15/236 R |
| 568829 | 4/1945 | United Kingdom | 15/236 R |

*Primary Examiner*—Robert L. Bleutge

*Attorney, Agent, or Firm*—John L. McGannon

[57] ABSTRACT

A tool having a handle and a blade secured to and extending transversely from one end of the handle. The tool is adapted to be manually placed in a conventional paint can with the blade near the inner surface of the bottom of the can when the can is tilted on its side to remove residual paint from the can. The blade has a flexible portion and a flat surface so that it can be moved along the inner surface of the can bottom to scrape the paint thereon toward one side wall portion when the can is tilted on its side. The flexibility of the blade allows its flat surface to remain in substantial surface-to-surface contact with the inner surface of the can bottom even though such inner surface has undulations. The handle is also flexible to permit it to bend to assure proper placement of the blade in the can near the bottom of the can. The outer periphery of the blade is curved and is complemental to the curved inner surface of the side wall of the can to assure optimum removal of paint along the side wall of the can as the tool is drawn out of the can.

6 Claims, 11 Drawing Figures

HAND TOOL FOR SCRAPING PAINT FROM PAINT CAN

BACKGROUND OF THE INVENTION

To remove residual paint from a conventional paint can, the can is typically turned upside down so that the paint can be poured out of the can and into another container or can. However, this procedure does not assure complete removal of the paint because of the way the paint can is constructed. The lip of the can prevents complete removal of the paint can there is always a residual amount of paint left in the can notwithstanding the efforts to remove it by pouring. Other attempts to do this have been made with putty knives and other such hand tools, but these tools are not suitable for this purpose and do not solve the problem of substantially complete removal of the residual paint from a paint can.

Disclosures which relates to scraping of surfaces inside a container include U.S. Pat. Nos. 1,704,329 and 4,159,839 and British Patent No. 568,829. The devices of these U.S. patents have been designed to scrape cooking and baking pots and bowls and do not suggest tools for removing residual paint from a conventional paint can. The British patent relates to a spoon for the removal of jam or jelly adhering to the sidewall of a jelly jar, but it does not suggest that the spoon can be modified for removing residual paint from a conventional paint can.

Because of the drawbacks associated with prior techniques for removing paint from paint cans and because of the lack of suitable hand tools, a need has arisen for an improved hand tool for accomplishing this purpose.

SUMMARY OF THE INVENTION

The present invention satisfies the aforesaid need by providing an improved hand tool which can be used with a conventional paint can for removing the residual paint which accumulates on the bottom of the can when substantially all of the paint has been used from the can and when the residual paint cannot be satisfactorily poured from the can. To this end, the tool of the present invention is adapted to be hand held and includes a handle having a blade rigid thereto near one end thereof. The blade extends transversely from the handle and has an outer curved periphery which is substantially complemental to the curvature of the inner surface of the sidewall of the paint can. The blade also has a generally flat bottom on one portion thereof so that the blade can engage the bottom of the can and scrape the paint from the bottom toward the sidewall when the can is tilted on its side. After the bottom has been scraped, the outer periphery of the blade then engages the inner surface of the sidewall near the bottom, following which the handle is pulled out of the can causing the blade to scrape the residual paint away from the bottom and toward the opening of the can whereupon the paint will be forced out of the can and into another container.

Either the handle or the blade or both are flexible to assure that the flat surface of the blade will be maintained in engagement with the bottom as the blade moves across the bottom toward one sidewall portion of the can. This is especially important where the bottom of the can is wavy or undulated because of the presence of concentric ribs stamped in the bottom to provide strength for it. The flexibility of either or both of the handle and blade assures that a substantially all of the paint on the bottom will be effectively scraped and moved toward a sidewall portion of the can, following which the blade can then be moved along such sidewall portion to force the residual paint in advance of the blade toward and out of the tilted top opening of the can. Thus, the tool of the present invention is suitable for cleaning and scraping paint from both the bottom and sidewall portions of conventional paint cans to substantially eliminate any waste of paint which has been a major problem in the past.

The primary object of the present invention is to provide an improved hand tool for scraping residual paint from a conventional paint can wherein the tool is suitable for scraping the inner surfaces of both the bottom and sidewall portions of a paint can notwithstanding the differences in shapes and contours of the bottom and sidewall, all to the end that substantially all residual paint is removed from the paint can with a simple manual manipulation of the tool as the paint can is tilted on its side.

Other objects of this invention will become apparent as the following specification progresses, references being had to the accompanying drawings for an illustration of the invention.

The hand tool of the present invention is broadly denoted by the numeral 10 and includes a handle 12 and a blade 14 which are connected together so that the blade extends transversely from one end of the handle. For purposes of illustration, the handle and blade are formed in an integral, one-piece construction and preferably are molded from a suitable plastic material to minimize production costs. However, the handle could be of a different material than the blade and secured to the blade in some suitable manner so that they are rigidly connected together to carry out the teachings of the present invention.

Figure 1:
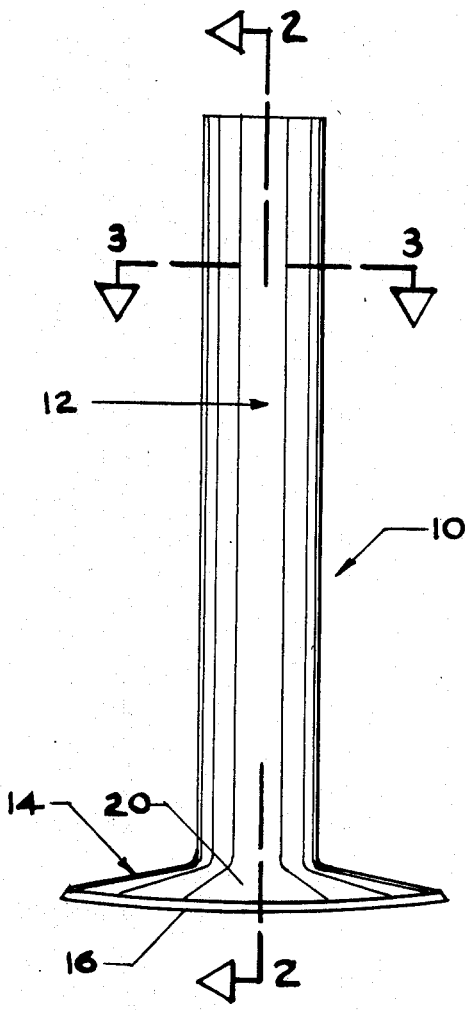
FIG. 1 is a front elevational view of the hand tool for scraping paint out of a can and forming the subject of the present invention.
Figure 2:
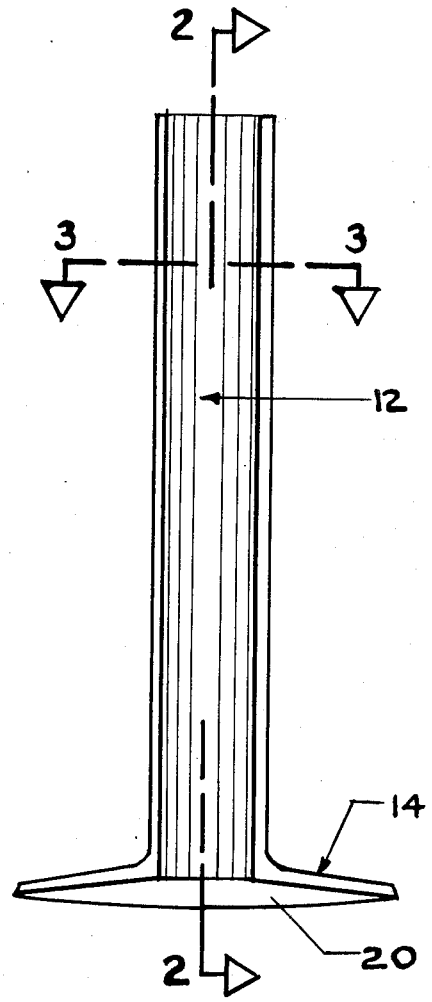
FIG. 2 is a rear elevational view of the tool.
Figure 3:
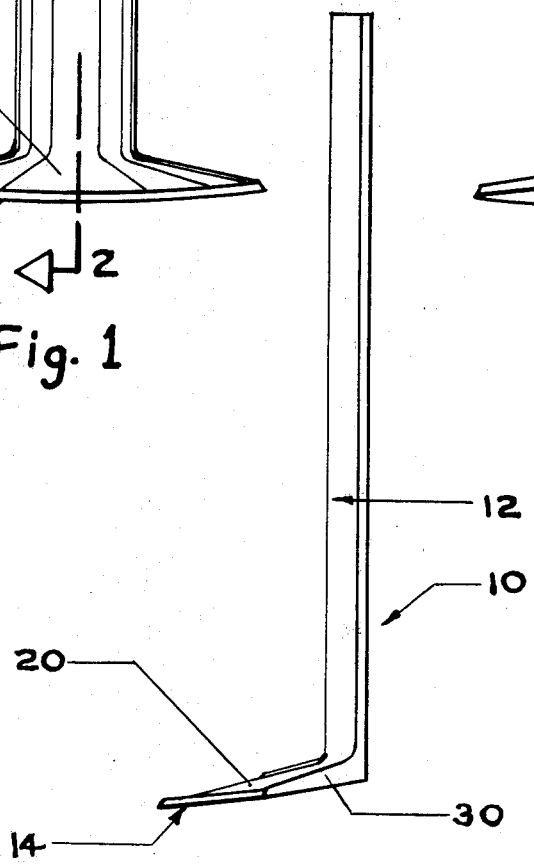
FIG. 3 is a side elevational view of the tool.
Figure 6:
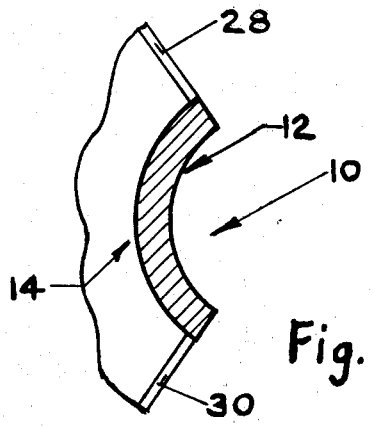
FIG. 6 is an enlarged cross-sectional view taken along lines 6—6 of FIGS. 1, 2 and 4.
Figure 5:
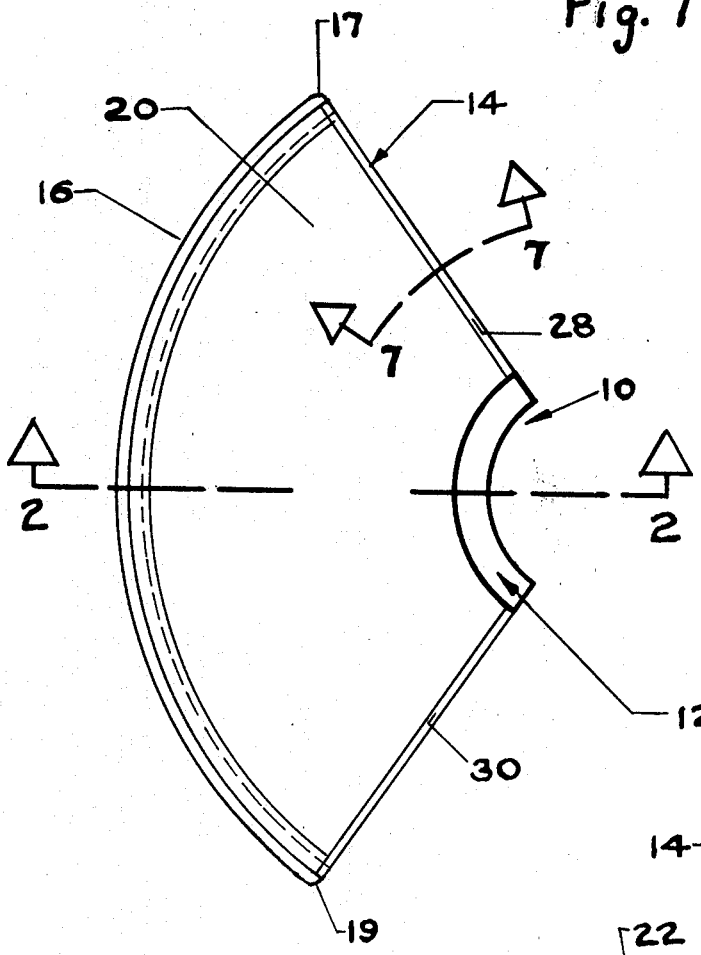
FIG. 5 is an enlarged, top plan view of the tool.
Figure 4:
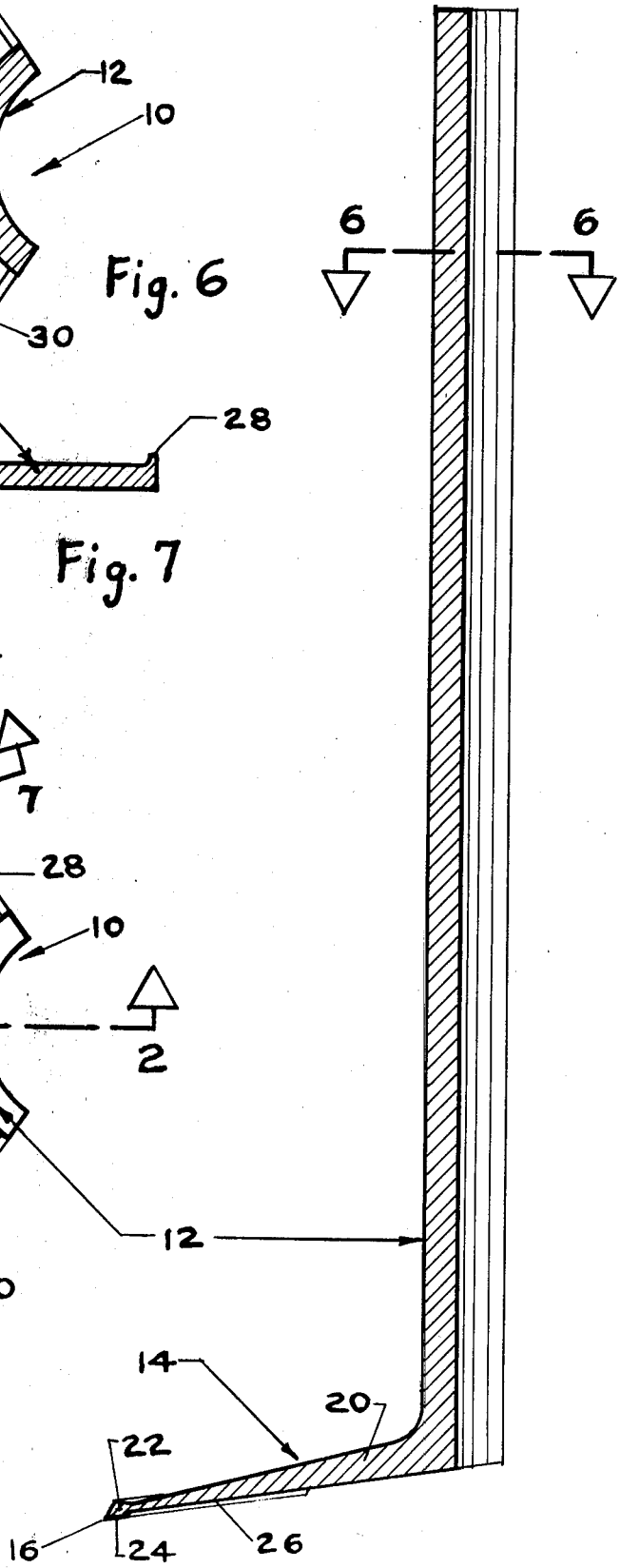
FIG. 4 is an enlarged, cross-sectional view taken along lines 2—2 of FIGS. 1, 2 and 5.

Handle 12 is crescent-shaped in transverse cross-section as shown in FIGS. 5 and 6. This shape imparts strength to the handle yet allows the handle to be flexible to a certain degree for a purpose hereinafter described. The handle is substantially straight and makes an angle of greater than 90° with the upper face of blade 14 as shown in FIGS. 3 and 4.

Blade 14 is fan-shaped as shown in FIG. 5 to present an area equivalent to a quadrant of the paint can to be scraped. The blade is provided with a curved outer peripheral edge 16 which extends from one end 17 of blade 14 to the opposite end 19 thereof. Blade 14 has a main body 20 which, in cross-section, is tapered as shown in FIG. 4, the greatest thickness of body 20 being at the location where it connects with handle 12 and the thinnest portion being just inward of the outer peripheral edge 16. A curved boss or enlargement 22 is connected to the thinnest part of body 20 and defines the outer peripheral, curved edge 16 as shown in FIG. 4. Enlargement 22 has a substantially flat surface 24 which is slightly off-set from the flat surface 26 of body 20. Flat surface 26 extends from enlargement 24 to the region at which the blade connects with the handle.

Figure 7:
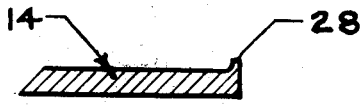
FIG. 7 is a fragmentary cross-sectional view taken along lines 7—7 of FIG. 5.

A pair of ribs 28 and 30 extend from respective ends 17 and 19 to handle 12 as shown in FIGS. 5, 6 and 7. These ribs are optional and are provided to reinforce the side edges of blade body 20 and also to limit paint from moving laterally of the central or main portion of the body when tool 10 is in use.

A main feature of tool 10 is the flexibility of either or both of handle 12 and blade 14. This flexibility assures that the flat bottom surfaces of body 20 and enlargement 22 will be in substantial surface-to-surface contact with the inner surface of the bottom of a conventional paint can even if such bottom is undulating as is usually the case to strengthen the bottom. Handle 12 is flexible because of its relatively long length and because of the material forming the handle. Blade 14 is flexible because of its relatively small thickness and because the thickness tapers from a relatively large value near the handle to a relatively small value near enlargement 22. Moreover, edge 16 has a curvature which is substantially complemental to the inside surface of the paint can to be scraped by tool 10; thus, edge 16 will engage the inner surface of the sidewall of the paint can to substantially completely scrape the paint therefrom and to draw the paint out of the can when the can is tilted to the side.

FIGS. 8*a*–8*d* show the sequential steps which are performed with tool 10 to scrape the bottom and sidewall of a paint can 32 when a residue of paint remains on the bottom of the can. The can has an opening 34 and, to use tool 10, the paint can is tipped so that the opening 34 is to the side.

Figure 8A:
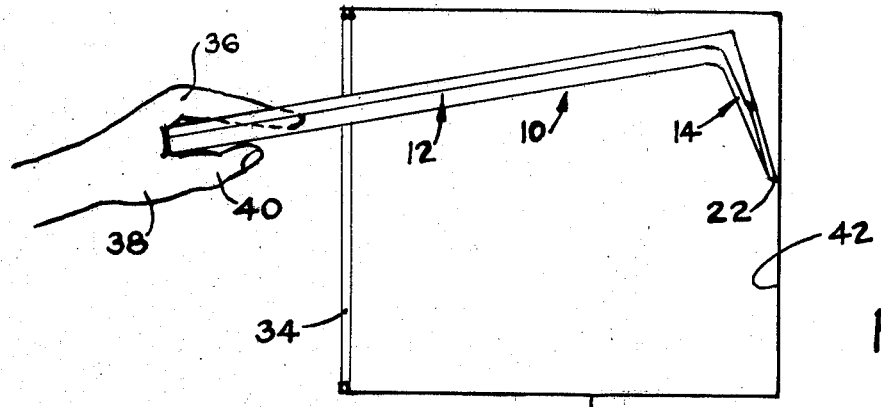
FIGS. 8*a*–8*d* are schematic views showing the sequential steps for scraping paint from the bottom and sides of a paint can using the tool of the present invention.

The user first inserts the tool into the paint can in the manner shown in FIG. 8*a*. The fact that handle 12 is crescent-shaped permits a finger 36 of the hand 38 to be received in the depression of the handle to permit a good grip with the thumb 40 of the hand.

Tool 10 is inserted far enough into the can so that enlargement 22 on the outer periphery of blade 14 engages the inner surface 42 of the bottom of the can. Then, the handle is forced further into the can until the flat lower surface of the blade is "bottomed out" on surface 42. In this case, surface 24 of enlargement 22 and surface 26 of blade body 20 are in substantially face-to-face relationship with surface 42.

Figure 8B:
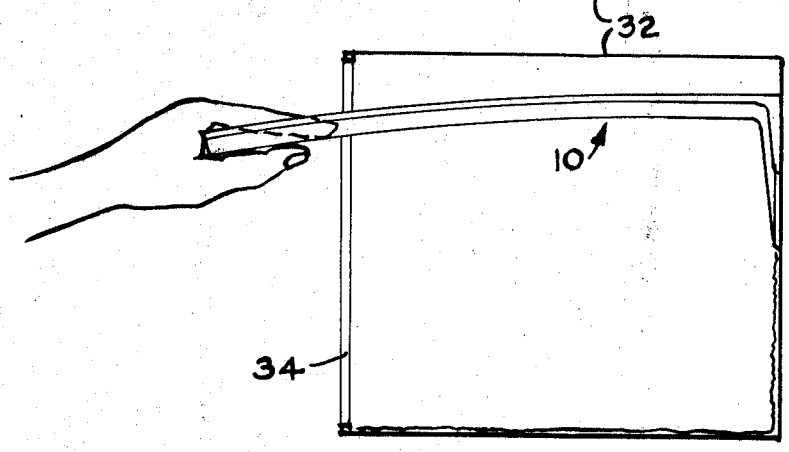

Before moving blade 14 into the position shown in FIG. 8*b*, blade 12 can flex in the manner shown in FIG. 8*b* to position blade 14 as high as possible with respect to the lowermost sidewall portion of the can without having the entire length of the blade in contact with the upper most portion of the sidewall. With the blade in the position shown in FIG. 8*b*, the user then pulls downwardly on the handle and the blade follows along inner surface 42. Even if surface 42 is wavy or undulating, the paint on the surface will still be scraped therefrom because the lower flat surfaces 24 and 26 of enlargement 22 and body 20 will follow the contour of inner surface 42 because of the flexibility of blade 20, especially in the region where enlargement 22 connects with blade body 20 as shown in FIG. 4. As the flat surfaces of blade body 20 and enlargement 22 follows surface 42, they scrape the paint and cause the paint to advance along with the blade. Some of the paint may flow slightly upwardly along the blade; however, ribs 28 and 30, if used, will substantially keep such paint from flowing sideways off the blade. The paint will therefor accumulate on the bottom sidewall portion in the manner shown in FIG. 8*c*.

Figure 8C:
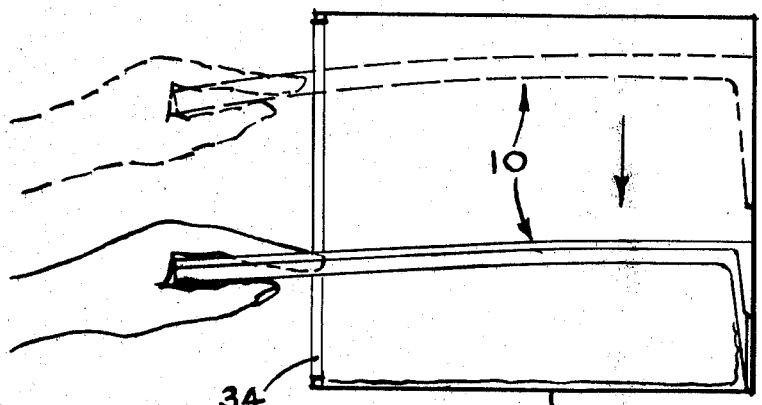
Figure 8D:
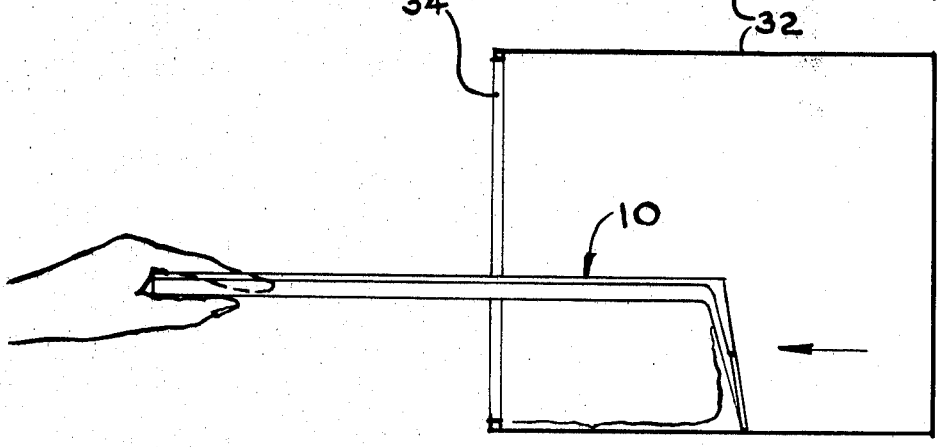

After the step shown in FIG. 8*c* has been completed, the blade is pulled out of the can and the accumulated paint will be advanced with the blade and out of the can through opening 34 thereof and into another container.

After this series of steps have been completed, the paint can can then be rotated so that another quadrant of the can can be scraped of paint, following which the steps illustrated in FIGS. 8*a*–8*d* are repeated. Since blade body 20 is shaped to a size equal to or slightly greater than the size of a quadrant of surface 42, it might take four passes through the can to obtain a complete removal of paint from surface 42 as well as from the sidewalls.

I claim:

1. A hand tool for scraping paint from the bottom and curved sidewall of a paint can comprising: a handle member having a pair of opposed ends; and a blade member integral with one end of the handle member and extending laterally therefrom, the blade member being fan-shaped and having an outer periphery provided with a curvature substantially complemental to the curvature of the sidewall of the paint can, said blade member having a flat surface for engaging the bottom of the paint can, the flat surface of the blade member extending throughout substantially the entire area of the blade member, the members being flexible to permit them to yield as the flat surface engages and moves along the bottom of the paint can.

2. A tool as set forth in claim 1, wherein said blade member has a pair of side edges, there being a rib extending along each side edge, respectively, of the blade member from the handle to the outer periphery thereof.

3. A tool as set forth in claim 1, wherein the angle between the blade and the handle members is greater than 90°.

4. A tool as set forth in claim 1, wherein the blade has an enlargement at the outer periphery therof, the enlargement having a flat lower surface for engaging the bottom surface of the can.

5. A tool as set forth in claim 1, wherein the thickness of the blade member decreases as the blade member extends from a location near the handle to a location near the outer periphery of the blade member.

6. A tool as set forth in claim 5, wherein the blade member has an enlargement at the outer periphery, the enlargement having a flat surface off-set from the flat surface of the blade.

* * * * *